US007857241B2

(12) United States Patent
Deng

(10) Patent No.: US 7,857,241 B2
(45) Date of Patent: Dec. 28, 2010

(54) CONFIGURATION STRUCTURE OF A SPRAY NOZZLE AND A SHOWER HEAD

(75) Inventor: Hao Deng, Fujian (CN)

(73) Assignee: Xiamen Solex Technology Ltd., Xiamen (CN)

( * ) Notice: Subject to any disclaimer, the term of this patent is extended or adjusted under 35 U.S.C. 154(b) by 228 days.

(21) Appl. No.: 12/358,229

(22) Filed: Jan. 22, 2009

(65) Prior Publication Data

US 2010/0180967 A1 Jul. 22, 2010

(51) Int. Cl.

| | |
|---|---|
| ***B05B 1/18*** | (2006.01) |
| ***B05B 1/16*** | (2006.01) |
| ***B05B 1/14*** | (2006.01) |
| ***A47K 3/28*** | (2006.01) |

(52) U.S. Cl. ..... 239/444; 239/436; 239/443; 239/550; 4/601; 4/605

(58) Field of Classification Search ..... 239/207, 239/208, 266, 267, 273, 280, 282, 436, 443, 239/444, 447, 525, 548, 550, 569, 581.1, 239/587.1; 4/601, 605; 137/625

See application file for complete search history.

(56) References Cited

U.S. PATENT DOCUMENTS 1,758,115 A * 5/1930 Kelly ..... 239/282
3,121,235 A * 2/1964 Gellmann ..... 4/570
5,481,765 A * 1/1996 Wang ..... 4/605
7,043,776 B1 * 5/2006 Wu ..... 4/601
7,197,776 B2 * 4/2007 Tsai ..... 4/615
7,458,112 B1 * 12/2008 Yang ..... 4/601
7,721,363 B2 * 5/2010 Huang ..... 4/605
7,748,649 B2 * 7/2010 Fujii et al. ..... 239/548

* cited by examiner

*Primary Examiner*—Darren W Gorman
(74) *Attorney, Agent, or Firm*—Rabin & Berdo, P.C.

(57) ABSTRACT

A configuration structure of a spray nozzle and a shower head, adapted to a wall outlet, includes a three-way control valve, a connecting rod and a spray unit. The three-way control valve has an inlet connected to the wall outlet, a front outlet connected to an inlet tube extending from a rear side of the connecting rod, and a lower outlet connected to a hose of the spray unit. The connecting rod has a closed lower end, an upper end connected with the shower head, and at least one spray head at a front side thereof. With the three-way control valve and the connecting rod, the front and lower outlets of the three-way control valve are connected to the spray nozzle and the connecting rod respectively to form two water passages. The upper end of the connecting rod is connected with the shower head.

3 Claims, 2 Drawing Sheets

CONFIGURATION STRUCTURE OF A SPRAY NOZZLE AND A SHOWER HEAD

BACKGROUND OF THE INVENTION

1. Field of the Invention

The present invention relates to a shower bath appliance, and more particularly to a configuration structure of a spray nozzle and a shower head 2. Description of the Prior Art There are two ways to mount a shower head. One type is movable, which is generally adapted to domestic use. The shower head is connected to a hose for supplying water, which is named a spray nozzle. The position of usage is movable. The spray nozzle may be held by hand or secured on a retaining bracket disposed on the wall. For the flexibility of the shower head, the shower head may be mounted with an adjustable rod to control its height. The adjustable rod is provided with a retaining bracket to position the spray nozzle for adjusting the angle of spraying.

The other type is immovable, which is adopted in an inn or apartment. The position of the shower head is fixed. The user has to stand at a limited area for taking a shower bath. This is not flexible in use. In some countries, such as America, the mounting position of a feed pipe is restricted. The wall-mount feed pipe is connected with the shower head. Nowadays, a demand for the wall-mount shower head coupled with the spray nozzle is increasing. Accordingly, the inventor of the present invention has devoted himself based on his many years of practical experiences to solve this problem.

SUMMARY OF THE INVENTION

The primary objective of the present invention is to provide a configuration structure of a spray nozzle and a shower head in conjunction with a wall outlet for good flexibility.

According to the present invention, there is provided a configuration structure of a spray nozzle and a shower head, adapted to a wall outlet, comprising a three-way control valve, a connecting rod and a spray unit; the three-way control valve having an inlet connected to the wall outlet, a front outlet connected to an inlet tube extending from a rear side of the connecting rod, and a lower outlet connected to a hose of the spray unit, the connecting rod having a closed lower end, an upper end connected with the shower head, and at least one spray head at a front side thereof.

Preferably, the spray unit comprises the spray nozzle, the hose connected to the spray nozzle, and a retaining seat for insertion of the spray nozzle, the retaining seat being movably coupled to the connecting rod through a fastening device.

Preferably, the three-way control valve is provided with a control switch for controlling water to flow out through either of the front outlet and the lower outlet.

With the three-way control valve and the connecting rod, the front and lower outlets of the three-way control valve are connected to the spray nozzle and the connecting rod respectively to form two water passages. The upper end of the connecting rod is connected with the shower head in order to assemble the spray nozzle and the shower head together. The three-way control valve is adjusted to control the water to flow out through either of the shower head and the spray nozzle for an optional shower bath. The user may assemble or disassemble the parts of the present invention by himself/herself. It is not necessary to provide an additional water passage or to damage the wall for coupling with the spray nozzle.

DETAILED DESCRIPTION OF THE PREFERRED EMBODIMENTS

Embodiments of the present invention will now be described, by way of example only, with reference to the accompanying drawings.

Figure 1:
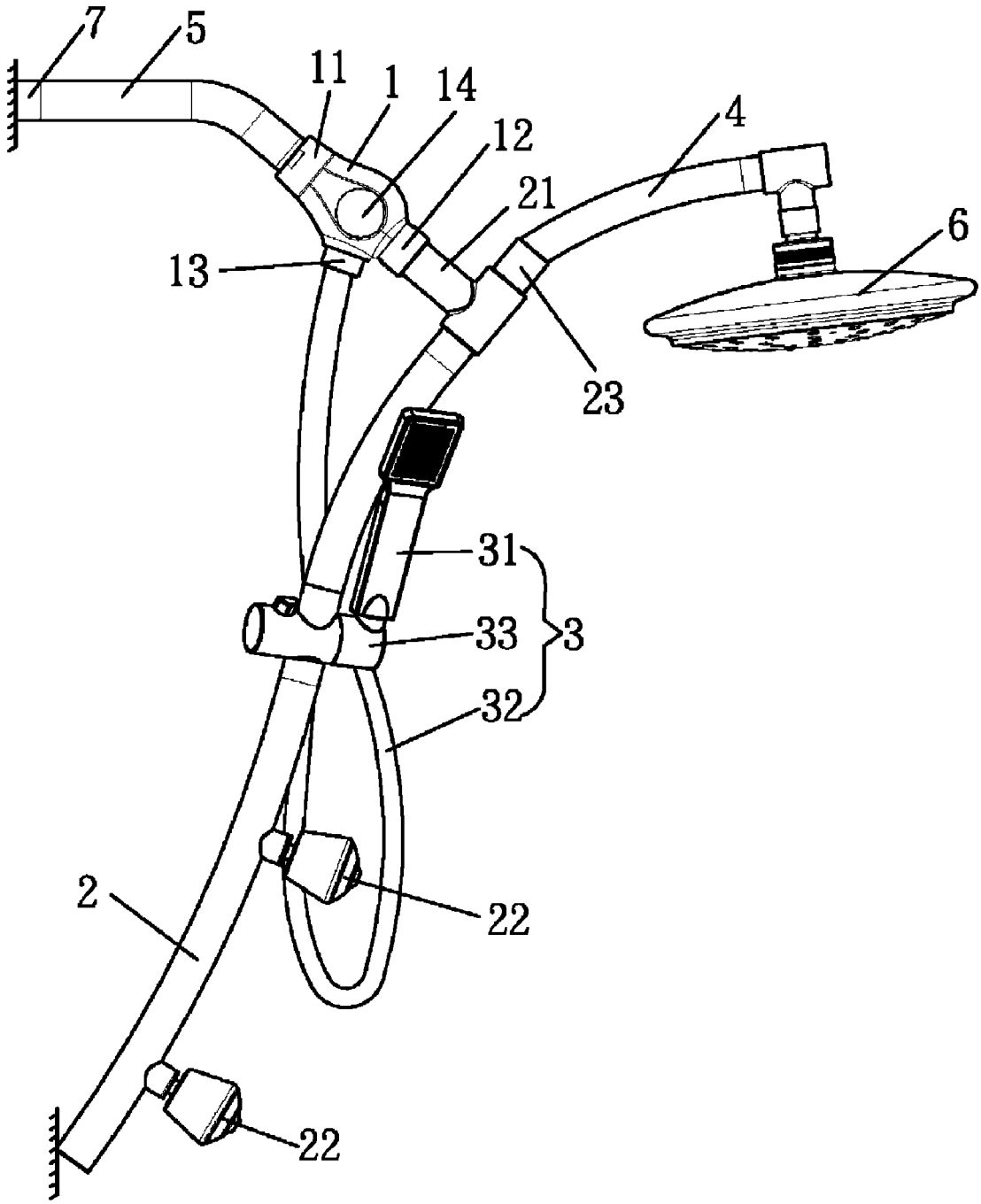
FIG. 1 is a schematic view of the present invention (mounting a spray nozzle)
Figure 2:
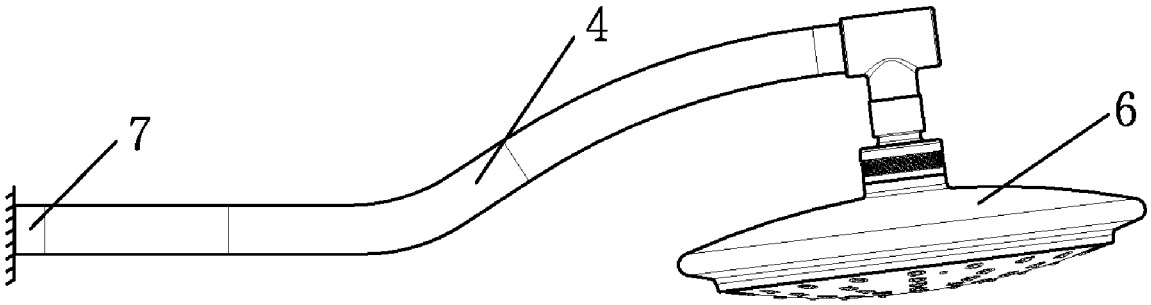
FIG. 2 is a schematic view of the present invention (dismounting) without the spray nozzle).

As shown in FIGS. 1 and 2, the present invention comprises a three-way control valve 1, a connecting rod 2, and a spray unit 3. The present invention further comprises two connecting tubes 4 and 5.

The connecting rod 2 comprises an inlet tube 21 at an upper rear side thereof, a closed lower end, two spray heads 22 at a front side thereof, and an outlet 23 at an upper end thereof.

The spray unit 3 comprises a spray nozzle 31, a hose 32 connected to the spray nozzle 31, and a retaining seat 33 for insertion of the spray nozzle 31.

As shown in FIG. 2, when the user wants to use a shower head 6 only, the shower head 6 is connected to a wall outlet 7 through the connecting tube 4. Alternatively, the shower head 6 may be directly connected to the wall outlet 7. This is a conventional connection of a fixed shower head device.

As shown in FIG. 1, the shower head is coupled with the spray unit. The wall outlet 7 is connected with one end of the connecting tube 5. The other end of the connecting tube 5 is connected to an inlet 11 of the three-way control valve 1. A front outlet 12 of the three-way control valve 1 is connected to the inlet tube 21 of the connecting rod 2. A lower outlet 13 of the three-way control valve 1 is connected to the hose 32 of the spray unit 3. The outlet 23 of the connecting rod 2 is connected with the shower head 6 through the connecting tube 4. The retaining seat 33 is movably coupled to the connecting rod 2 with a fastening device (not shown in the drawings). The connecting rod 2 may be in a curve shape. The assembly of the present invention having the spray unit is completed.

In operation, when the water to flow out through the spray nozzle 31 is required, a control switch 14 provided on the three-way control valve 1 will be adjusted to control the water to flow out through the spray nozzle 31 via the lower outlet 13 and the hose 32. The spray nozzle 31 may be positioned on the retaining seat 33 which is adjustable along the connecting rod 2. When the water to flow out through the shower head 6 is required, the control switch 14 on the three-way control valve 1 will be adjusted to control the water to flow out through the shower head 6 via the front outlet 12 and the connecting rod 2. Meanwhile, the water also flows out through the spray heads 22 of the connecting rod 2. The connecting rod 2 may be provided with a retaining bracket to be secured on a wall for enhancing the steadiness of the connecting rod 2 in use.

According to the configuration structure of the spray nozzle and the shower head of the present invention, the user may assemble or disassemble the parts of the present invention by himself/herself. It is not necessary to provide an additional water passage or to damage the wall for coupling with the spray nozzle. The user may have an optional shower bath.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A configuration structure of a spray nozzle and a shower head, adapted to a wall outlet, comprising a three-way control valve, a connecting rod and a spray unit; the three-way control valve having an inlet connected to the wall outlet, a front outlet connected to an inlet tube extending from a rear side of the connecting rod, and a lower outlet connected to a hose of the spray unit, the connecting rod having a closed lower end, an upper end connected with the shower head, and at least one spray head at a front side thereof.

2. The configuration structure of a spray nozzle and a shower head as claimed in claim 1, wherein the spray unit comprises the spray nozzle, the hose connected to the spray nozzle, and a retaining seat for insertion of the spray nozzle, the retaining seat being movably coupled to the connecting rod through a fastening device.

3. The configuration structure of a spray nozzle and a shower head as claimed in claim 1, wherein the three-way control valve is provided with a control switch for controlling water to flow out through either of the front outlet and the lower outlet.

* * * * *